US007025613B2

(12) United States Patent
Satou

(10) Patent No.: US 7,025,613 B2
(45) Date of Patent: Apr. 11, 2006

(54) FLEXIBLE BOARD CONNECTOR AND CONNECTION STRUCTURE BETWEEN CIRCUIT BOARD AND FLEXIBLE BOARD

(75) Inventor: Kunihiro Satou, Fukuyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/041,983

(22) Filed: Jan. 26, 2005

(65) Prior Publication Data

US 2005/0170685 A1 Aug. 4, 2005

(30) Foreign Application Priority Data

Jan. 30, 2004 (JP) ..... P2004-023133

(51) Int. Cl.
*H01R 13/15* (2006.01)

(52) U.S. Cl. ..... 439/260; 439/495

(58) Field of Classification Search ..... 439/495, 439/260

See application file for complete search history.

(56) References Cited

U.S. PATENT DOCUMENTS

| | | | | |
|---|---|---|---|---|
| 4,519,133 | A * | 5/1985 | Pansanel | 439/260 |
| 5,194,017 | A | 3/1993 | Consoli | |
| 5,211,577 | A | 5/1993 | Daugherty | |
| 5,240,430 | A * | 8/1993 | Soes | 439/260 |
| 6,056,572 | A * | 5/2000 | Matsumoto et al. | 439/260 |
| 6,089,904 | A | 7/2000 | Wu | |
| 6,159,038 | A * | 12/2000 | Wu | 439/495 |
| 6,379,176 | B1 * | 4/2002 | Ohsawa et al. | 439/495 |
| 6,447,305 | B1 | 9/2002 | Roberts | |

FOREIGN PATENT DOCUMENTS

| | | |
|---|---|---|
| DE | 1 920 988 | 11/1970 |
| DE | 197 50 224 | 6/1999 |
| JP | 9-22760 | 1/1997 |
| JP | 9-69678 | 3/1997 |

OTHER PUBLICATIONS

European Search Report dated Apr. 11, 2005.

* cited by examiner

*Primary Examiner*—Tho D. Ta
(74) *Attorney, Agent, or Firm*—Nixon & Vanderhye P.C.

(57) ABSTRACT

A flexible board connector includes a casing having an opening in its upper surface and placed inside a through-hole of a circuit board. Terminals of the circuit board are connected to outside contact portions of conductive contacts which portions protrude from proximity to an upper end of a side surface of the casing. A portion of the flexible board is inserted into an insertion hole through the opening, and then a press member is slid toward the opening. Thereby, inside contact portions of the contacts and the inserted portion of the flexible board are sandwiched to be fixed by the press member and a wedge-shaped push-up block located in the casing. The press member has a cover portion which allows a portion of the flexible board located outside the insertion hole to be bent in the direction generally parallel to an upper surface of the circuit board.

11 Claims, 4 Drawing Sheets

FLEXIBLE BOARD CONNECTOR AND CONNECTION STRUCTURE BETWEEN CIRCUIT BOARD AND FLEXIBLE BOARD

CROSS-REFERENCE TO RELATED APPLICATIONS

This nonprovisional application claims priority under 35 U.S.C. §119 (a) on Patent Application No. 2004-023133 filed in Japan on 30 Jan. 2004, the entire contents of which are incorporated herein by reference.

BACKGROUND OF THE INVENTION

The present invention relates to a flexible board connector for electrically connecting a flexible board to a circuit board to each other, and to a connection structure between a circuit board and a flexible board.

In recent years, electronic equipment such as portable telephones and video cameras has been increasingly miniaturized, while having a multiplicity of electronic components incorporated inside. In most of these electronic components, leads or terminals are electrically connected to component mounting lands disposed on a circuit board by means of solder. In each of miniaturized portable telephones, a plurality of circuit boards are normally used. On those circuit boards, relatively large component parts such as a liquid crystal display module and a keypad are disposed. Then, flexible boards are widely used for electrical connection between the circuit boards or between the circuit boards and other component parts.

Conventionally, the following connectors or the like are used for the connection of flexible boards to circuit boards.

(1) As shown in FIG. 5, a terminal portion 57 of a flexible board 56 is inserted into a connector 53 as shown by arrow D. The connector 53 has a swing portion 52 that is placed on a circuit board 51 and swings as shown by arrow C. The terminal portion 57 is fixed by the swing portion 52.

(2) As shown in FIG. 6, a connector 63 is placed on a circuit board 61 and has a contact 62 and an engagement claw. A flexible board 66 has an engagement hole for engaging with the engagement claw, and a signal input/output terminal 65. The flexible board 66 is engaged with the connector 63, as shown by arrow E, so that the signal input/output terminal 65 is brought into contact with the contact 62 to obtain conduction (see JP H09-22760A).

(3) As shown in FIG. 7, a flexible board 72 is placed on a surface of a circuit board 71 as shown by arrow F. Then, the flexible board 72 is sandwiched as shown in arrow G by a holding member 74 which covers a portion of the flexible board 72 to be fitted to the circuit board 71. As a result, a protrusion 76, which is provided within the holding member 74 and connected to a plate spring 75, presses a signal terminal 78 provided on a rear surface of the flexible board 72 against a signal terminal 79 provided on a top surface of the circuit board 71, and thus electrical conduction is obtained (see JP H09-69678A).

For electronic equipment that has been increasingly miniaturized, the reduction of its thickness is regarded as important in particular. Under the situation that electronic components or the like are directed toward downsizing and thinning, connectors for the flexible boards are also desired for downsizing and thinning.

However, in the case with use of such a connector 53, 63 as stated above in (1) and (2), the connector 53, 63 is placed on a circuit board 51, 61. Thereby, the connectors 53, 63 are entirely protruded from the top surface of the circuit board 51, 61. This disadvantageously makes it hard to miniaturize the circuit board 51, 61 and the flexible board 56, 66 which are connected to each other. For reduction in thickness of the connector 53, 63, it is conceivable to decrease the thickness of components in the connector 53, 63, such as insulators, terminals or the like. However, this disadvantageously incurs decreases in structural strength, connection failures and the like.

As to the connector 63 in (2), since the circuit board 61 and the flexible board 66 are connected to each other by engaging the engagement claw with the engagement hole, connection strength is relatively weak.

Meanwhile, when the circuit board 71 and the flexible board 72 are connected to each other without using any connector as in the case of (3), the holding member 74 is poor in versatility. This causes increase of cost. Further, the holding member 74 covers a much larger portion of the flexible board 72 in area than the portion where the signal terminal 78 is formed. Also, the holding member 74 has the plate spring 75 and the protrusion 76 in its inside. Moreover the holding member 74 is placed so as to protrude onto the circuit board 71. As a result, these make it difficult to downsize the components.

SUMMARY OF THE INVENTION

An object of the present invention is therefore to provide a connector for use in flexible boards, the connector being downsized and thinned without any deterioration in strength or performance.

In order to achieve the above-mentioned object, the present invention provides, the present invention provides a flexible board connector comprising:

a casing;

a contact having an inside contact portion located inside the casing and an outside contact portion protruding from proximity to an upper end of a side surface of the casing; and clamp means at least partly placed within the casing, being movable relative to the casing, and having a clamp surface forming an insertion hole together with the inside contact portion of the contact, wherein a movement of the clamp means relative to the casing makes the insertion hole narrower.

With this constitution, the outside contact portion of the contact protrudes from proximity to the upper end of the side surface of the casing. Meanwhile, the inside contact portion of the contact defines the insertion hole together with the clamp surface of the clamp means. Therefore, for example, by connecting the outside contact portion to a terminal or the like formed on the surface of the circuit board and by inserting and clamping a portion of the flexible board into the insertion hole, the terminal formed at the portion of the flexible board can be connected to the inside contact portion. As a result, the circuit board and the flexible board can be electrically and mechanically connected to each other reliably. Also, since the outside contact portion protrudes outward from proximity to the upper end of the side surface of the casing, the terminal and the outside contact portion can be connected to each other by placing the casing into the hole of the circuit board, on the surface of which terminals or the like are formed. Thereby, the overall thickness of the circuit board and the flexible board connector is prevented from significantly increasing. As a consequence, downsizing of electronic equipment or the like using the flexible board connector can effectively be achieved.

In one embodiment of the present invention, an opening of the insertion hole is positioned in proximity to the upper end of the side surface of the casing.

According to this embodiment, since the opening of the insertion hole is positioned in proximity to the upper end of the side surface of the casing, the portion of the flexible board can easily and securely be inserted into the insertion hole under the condition that the casing is placed, for example, inside the hole of the circuit board.

Preferably, the opening of the insertion hole is formed in an upper surface of the casing in proximity to the upper end of the side surface of the casing. In this case, the portion of the flexible board can easily and securely be inserted into the insertion hole even under the condition that the whole casing is placed inside the hole of the circuit board.

In one embodiment of the present invention, an outer peripheral surface of the casing is generally cup-like shaped, and the insertion hole is oriented to an oblique direction with respect to a bottom surface of the casing.

According to this embodiment, since the insertion hole is oriented oblique to the bottom surface of the casing, a size necessary for the insertion hole to accommodate the portion of the flexible board is effectively reduced in a direction parallel to the bottom surface of the casing. As a consequence, the flexible board connector can effectively be downsized.

In one embodiment of the present invention, the clamp means has a holding portion for bending a non-clamp portion of the clamped flexible board to a particular direction.

According to this embodiment, for example, a portion of the flexible board placed inside the insertion hole is clamped by the clamp means. Also, non-clamp portion of the flexible board is bent in a particular direction by the holding portion of the clamp means. For instance, the non-clamp portion of the flexible board can be bent in such a direction as not to significantly protrude from the surface of the casing. Accordingly, the circuit board and the flexible board which are connected to each other by this flexible board connector can effectively be downsized.

In one embodiment of the present invention, a connection structure between circuit board and flexible board, comprising:

the flexible board connector as defined above;

a circuit board having a circuit, a connecting terminal connected to the circuit, and a hole formed in proximity to the connecting terminal; and a flexible board having wiring, and a connecting terminal connected to the wiring, wherein at least a portion of the casing of the flexible board connector is placed inside the hole of the circuit board, the connecting terminal of the circuit board is connected to the outside contact portion of the contact of the flexible board connector, and a portion of the flexible board is positioned within the insertion hole of the flexible board connector and clamped by the clamp means, while the connecting terminal of the flexible board is connected to the inside contact portion of the contact of the flexible board connector.

In this flexible board connector, the outside contact portion is positioned in proximity to the upper end of the side surface of the casing, while the connecting terminal is formed in proximity to the hole in the circuit board. Therefore, under the condition that at least the portion of the casing is placed inside the hole, the outside contact portion of this flexible board connector and the connecting terminal of the circuit board are easily and securely connected to each other. As a result, the portion of the flexible board connector protruding from the surface of the circuit board is lessened, the overall thickness of the circuit board and the flexible board connector as a whole can effectively be prevented from significantly increasing. Thus, electronic equipment, when made up by using this flexible board connector, can effectively be downsized.

Also, since the portion of the flexible board is positioned within the insertion hole of the flexible board connector and clamped by the clamp means, the flexible board and the circuit board are mechanically and electrically connected to each other effectively via the flexible board connector.

The flexible board connector of this constitution is applicable to different flexible boards and circuit boards by forming the arrangement that the outside contact portion into a shape corresponding to the connecting terminal of the circuit board, and by forming the inside contact portion into a shape corresponding to the connecting terminal of the flexible board. That is, only by changing the shape of the contacts, the flexible board connector becomes applicable to different flexible boards and circuit boards, hence high versatility, so that the manufacturing cost can be reduced.

Further, the flexible board connector is effectively downsized since the casing has only to be formed into enough dimensions to accommodate the portion of the flexible board.

In one embodiment of the present invention, the opening of the insertion hole of the flexible board connector is positioned in an upper surface of the casing in proximity to the upper end of the side surface of the casing, an outer peripheral surface of the casing of the flexible board connector is generally cup-like shaped, and the insertion hole is oriented to an oblique direction with respect to a bottom surface of the casing, the clamp means of the flexible board connector has a holding portion, and a portion of the flexible board located outside the insertion hole is bent by the holding portion of the clamp means of the flexible board connector so as to be oriented substantially parallel to a top surface of the circuit board.

According to this embodiment, the flexible board is partly positioned within the insertion hole of the flexible board connector, while the portion of the flexible board positioned outside the insertion hole is bent by the holding portion of the clamp means of the flexible board connector. The bent portion of the flexible board is oriented substantially parallel to the top surface of the circuit board, and therefore, positioned at a position close to the flexible board connector and the surface of the circuit board. That is, the portion of the flexible board outside the flexible board connector is prevented from significantly protruding from the flexible board connector or the circuit board. Accordingly, it is possible to effectively downsize the circuit board and the flexible board connected to each other by this flexible board connector. As a result, it is possible to effectively downsize electronic equipment or the like using this connection structure between circuit board and flexible board.

In one embodiment of the present invention, the hole of the circuit board is a through-hole passing through the circuit board.

According to this embodiment, at least a portion of the casing is placed inside the through-hole of the circuit board. Therefore, even with a relatively small thickness of the circuit board, the casing can be placed to the circuit board, for example, in such a state as to be almost never protruded from the surface of the circuit board. As a result, the whole connection structure between circuit board and flexible board can effectively be thinned.

In one embodiment of the present invention, the hole of the circuit board is a non-through-hole having a depth smaller than thickness of the circuit board.

According to this embodiment, at least a portion of the casing is placed inside the non-through-hole of the circuit board. For instance, by making the depth of the non-through-hole generally equal to the thickness of the casing, the casing is placed to the circuit board so as to be not protruded from any surfaces of the circuit board. As a result, the overall thickness of the flexible board connector and the circuit board is effectively be thinned.

Further, the bottom portion of the casing placed in the non-through-hole is not exposed in the rear surface of the circuit board because the hole of the circuit board is a non-through-hole. Accordingly, there is no fear that the casing may be protruded toward the top surface side of the circuit board or fall off due to a force derived from the rear surface side of the circuit board. Thus, the circuit board and the flexible board are stably connected to each other.

As shown above, the flexible board connector according to the present invention includes a casing, a contact having an outside contact portion protruding from proximity to an upper end of a side surface of the casing, and clamp means. The clamp means is at least partly placed within the casing and movable relative to the casing. Moreover, the clamp means has a clamp surface that defines an insertion hole together with the inside contact portion of the contact. Further, the clamp means makes it possible to narrow the insertion hole by moving relative to the casing. Therefore, the casing of the flexible board connector is placed in the hole of the circuit board, and the flexible board is electrically and mechanically fixed by being partly inserted into the insertion hole of the connector, by which the overall thickness of the circuit board, the connector and the flexible board can be reduced as compared with the prior art.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERED EMBODIMENTS

Hereinbelow, the present invention is described in detail by way of embodiments thereof illustrated in the accompanying drawings.

Figure 1:
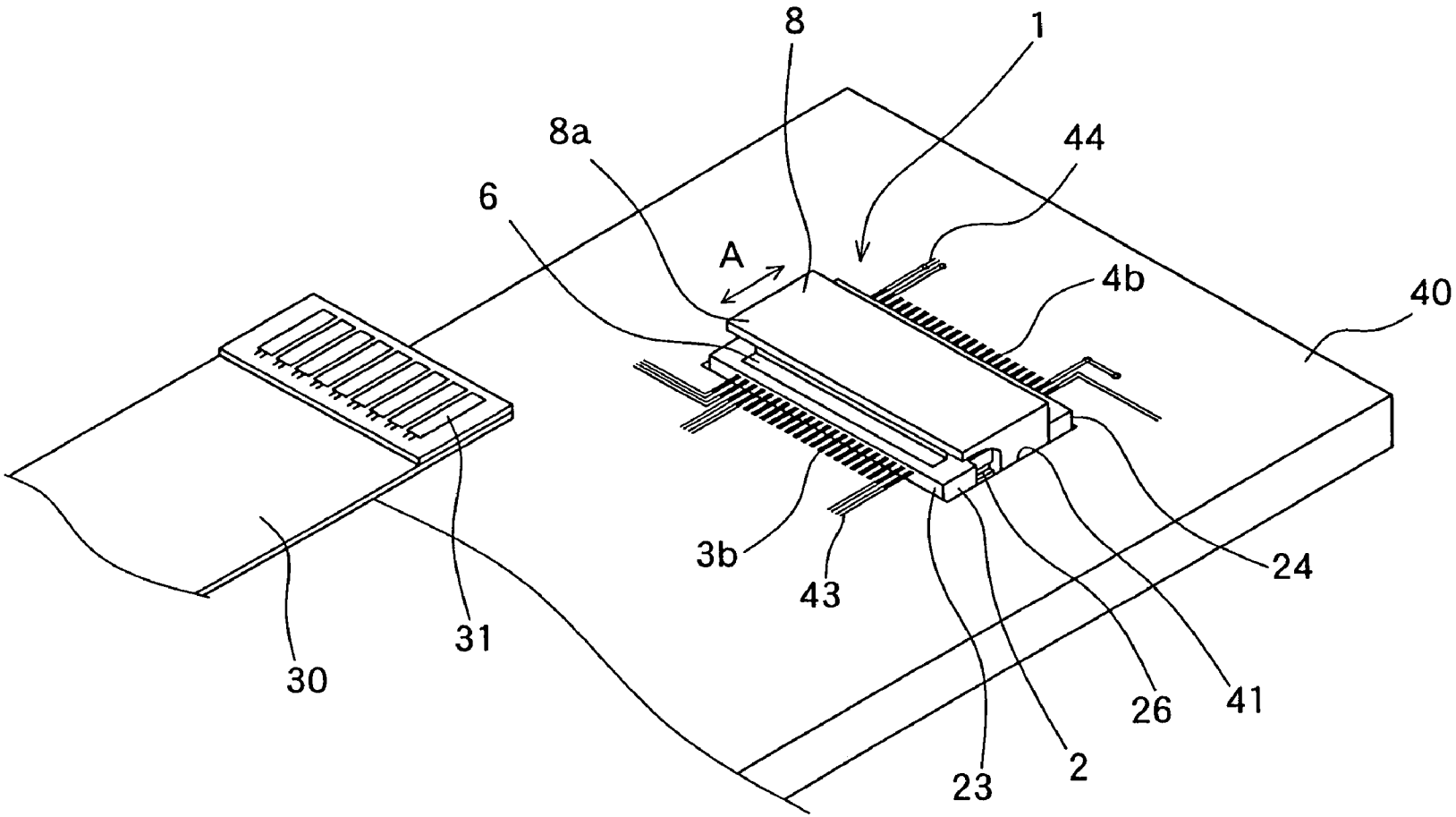
FIG. 1 is a perspective view showing a flexible board connector according to an embodiment of the present invention.

FIG. 1 is a perspective view showing a flexible board connector according to an embodiment of the present invention. The flexible board connector 1 fixes a flexible board 30 to a circuit board 40 and electrically connects wiring of the flexible board 30 to circuits of the circuit board 40.

The flexible board connector 1 has a generally rectangular parallelepiped casing 2, where the casing 2 is placed in a generally rectangular through-hole 41 formed in the circuit board 40. The casing 2 has an upper end portion protruded from a top surface of the circuit board 40.

The flexible board connector 1 includes a plurality of conductive first and second contacts 3, 4 to electrically connect a circuit of the circuit board 40 to interconnect pattern as wiring of the flexible board 30.

The first and second contacts 3, 4 have inside contact portions 3*a*, 4*a* located inside the casing 2, and a outside contact 3*b*, 4*b* located outside the casing 2. That is, an outside contact portion 3*b* of the first contact 3 protrudes from a side surface 23 which is a side surface portion of the casing 2 protruding from the top surface of the circuit board 40 and which extends along the lengthwise direction of the casing. Also, an outside contact portion 4*b* of the second contact 4 protrudes from a side surface 24 which is opposed to the side surface 23 from which the first contact 3 protrudes. The plural first and second contacts 3, 4 are, in either case, arrayed in parallel to each other to extend along the longitudinal direction of the casing 2.

The outside contact portion 3*b* of the first contact 3 and the outside contact portion 4*b* of the second contact 4 are electrically and mechanically connected by means of solder to connecting terminals 43, 44, respectively, formed near the through-hole 41 of the circuit board 40.

The casing 2 has an opening 6 in an upper side surface thereof, the opening 6 being near an upper end of the side surface of the casing 6. The opening 6 is provided in proximity to the side surface 23 from which the outside contact portion 3*b* of the first contact 3 protrudes. The opening 6 continues into an insertion hole formed within the casing 2. The opening 6 is so formed that a connecting portion 31 of the flexible board 30 is inserted hereinto. The opening 6 has a rectangular shape of longitudinally extending at the upper side surface of the casing 2.

The protruding portion of the casing 2 from the top surface of the circuit board is mostly covered with an upper portion of a press member 8 which serves as clamp means. The upper portion of the press member 8 has a rectangular shape in a plain view. The longer side of the press member 8 is formed so as to have a length generally equal to the longitudinal length of the casing 2. The shorter side of the upper portion of the press member 8 continues into a support portion thereof which extends toward a bottom portion of the casing 2. On an inner side surface of the support portion, an engagement claw is formed. This engagement claw is engaged with a guide groove 26 formed in the lateral side surface of the casing 2 so that the press member 8 can be moved along the guide groove 26 in the lateral direction as shown by arrow "A." A cover portion 8*a* is formed along a longer side verge of the upper portion of the press member 8. The cover portion 8*a* is positioned above the opening 6 of the upper side surface of the casing 2 when the press member 8 moves toward the side surface 23 of the casing 2.

Figure 2:
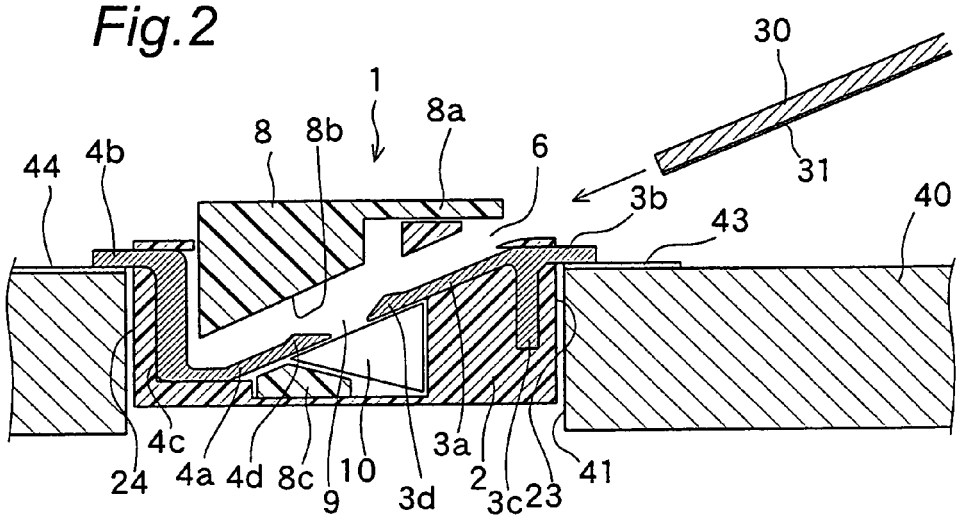
FIG. 2 is a view showing a state in which the flexible board connector placed on a circuit board is laterally cut according to the embodiment of the present invention.

FIG. 2 is a view showing a state in which the flexible board connector 1 placed on the circuit board 40 is cut laterally.

As shown in FIG. 2, the inside contact portions 3*a*, 4*a* of the first and second contacts 3, 4 are respectively placed in the casing 2. The inside contact portion 3*a* of the first contact 3 is positioned on a slant along a sloped surface formed in an inner surface of the casing 2. Between the inside contact portion 3*a* and the outside contact portion 3*b* of the first contact 3, a fixing portion 3*c* is connected. The fixing portion 3*c* extends toward the bottom portion of the casing 2 and is fitted to a fixing hole formed in the casing 2.

The second contact 4 has a vertical portion 4*c* adjoining the outside contact portion 4*b*. The vertical portion 4*c* extends along a vertically extending inner surface of the casing 2 toward its bottom. The inside contact portion 4*a* extends from the vertical portion 4*c* toward the opening 6 of the casing 2.

At a fore end of the inside contact portion 3*a* of the first contact 3, there is formed a contact terminal 3*d* which has gradually increasing thickness. Also, at a fore end of the inside contact portion 4*a* of the second contact 4, there is formed a contact terminal 4*d* which has gradually increasing thickness. The contact terminals 3*d*, 4*d* of the first and second contacts are placed close to each other.

In the casing 2, an insertion hole 9 is formed by a clamp surface 8*b*, which is the lower side surface of the press member 8, and the inside contact portions 3*a*, 4*a* of the first and second contacts 3, 4. The insertion hole 9, which continues to the opening 6 of the upper side surface of the casing 2, is inclined with respect to the bottom surface of the casing 2.

A slide member 8*c* is located under the insertion hole 9. The slide member 8*c* is formed integrally with the press member 8 to move along with the press member 8. In an upper side surface of the slide member 8*c*, there is formed an inclined surface which is inclined downward so as to be oriented toward the first contact 3, as viewed in a lateral cross section of the connector. A wedge-shaped push-up block 10 is placed between the slide member 8*c* and the insertion hole 9. A surface of the push-up block 10 which surface makes contact with the slide member 8*c* is an inclined surface which is inclined downward toward the first contact 3. Meanwhile, another surface of the push-up block 10 on the side of the insertion hole 9 is an inclined surface which is inclined upward toward the first contact 3. The surface of the push-up block 10 on the side of the insertion hole 9 is generally parallel and close to lower faces of the inside contact portions 3*a*, 4*a* of the first and second contacts 3, 4.

The flexible board connector 1 having the above-stated construction connects the flexible board 30 to the circuit board 40 in the following manner.

First, in the case where the cover portion 8*a* is positioned above the opening 6 of the casing 2, the press member 8 is moved toward the second contact 4 so that the opening 6 is exposed. When the press member 8 moves toward the second contact 4, the slide member 8*c* moves toward the second contact 4 along with the press member 8. As the result, the push-up block 10 whose lower surface is in contact with the inclined upper surface of the slide member 8*c* moves toward the bottom surface of the casing 2.

The connecting portion 31 of the flexible board is inserted into the casing 2 through the exposed opening 6. The connecting portion 31 of the flexible board inserted into the casing 2 is positioned in the insertion hole 9 formed between the clamp surface 8*b* of the press member 8 and the inside contact portions 3*a*, 4*a* of the first and second contacts 3, 4. As shown in the sectional view of FIG. 3, the connecting portion 31 of the flexible board 30 has its fore end 33 which is brought into contact with the clamp surface 8*b* by weight of the flexible board 30 outside of the connector 1.

Figure 4:
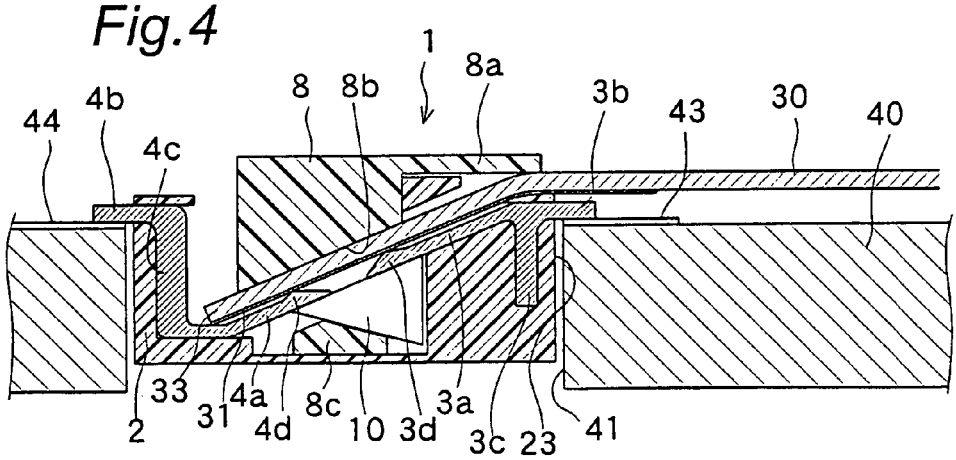
FIG. 4 is a sectional view showing another state in which the flexible board is connected to the circuit board by using the flexible board connector according to the embodiment of the present invention.
Figure 5:
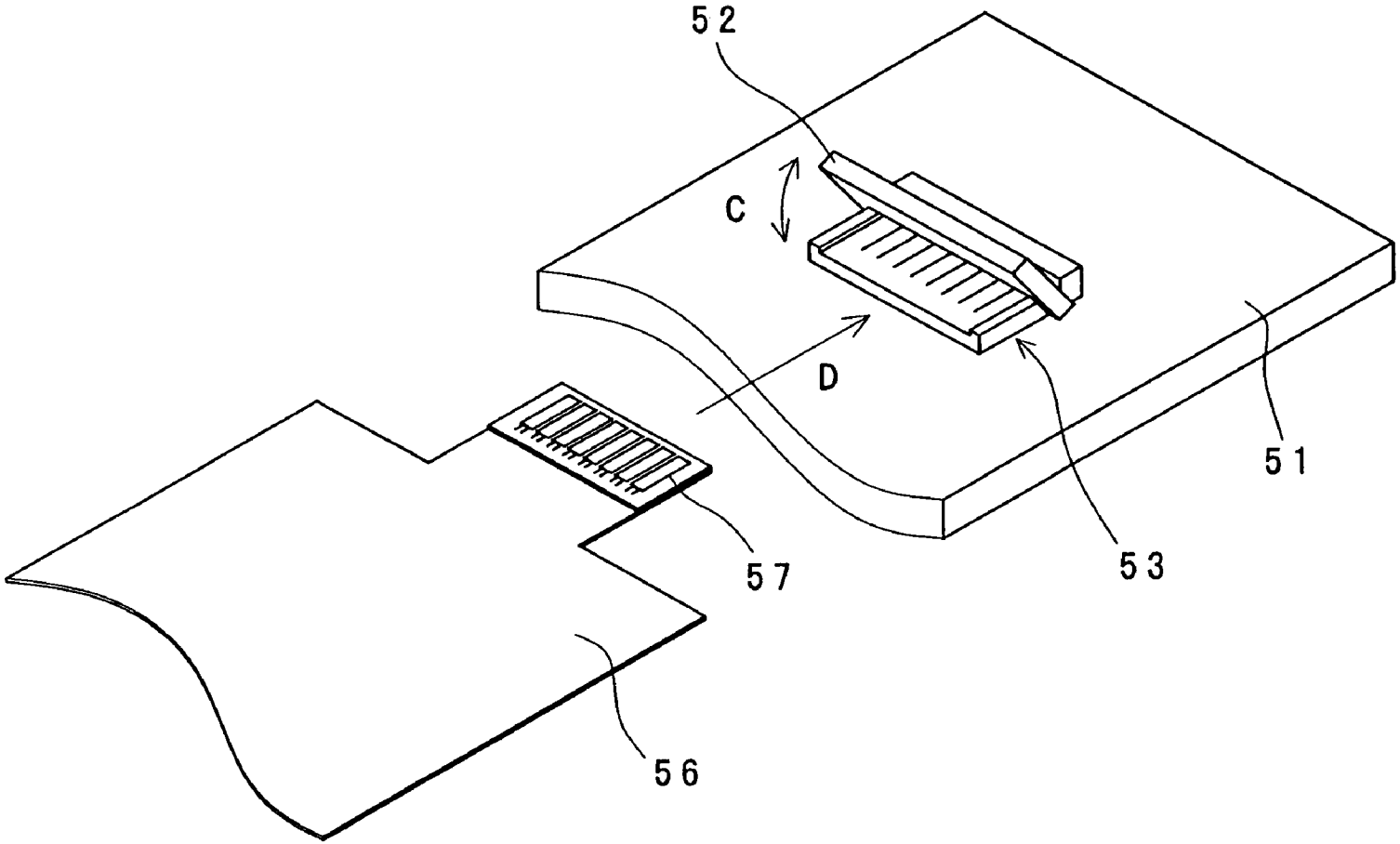
Fig5 PRIOR ART
FIG. 5 is a perspective view showing a prior art flexible board connector.
Figure 6:
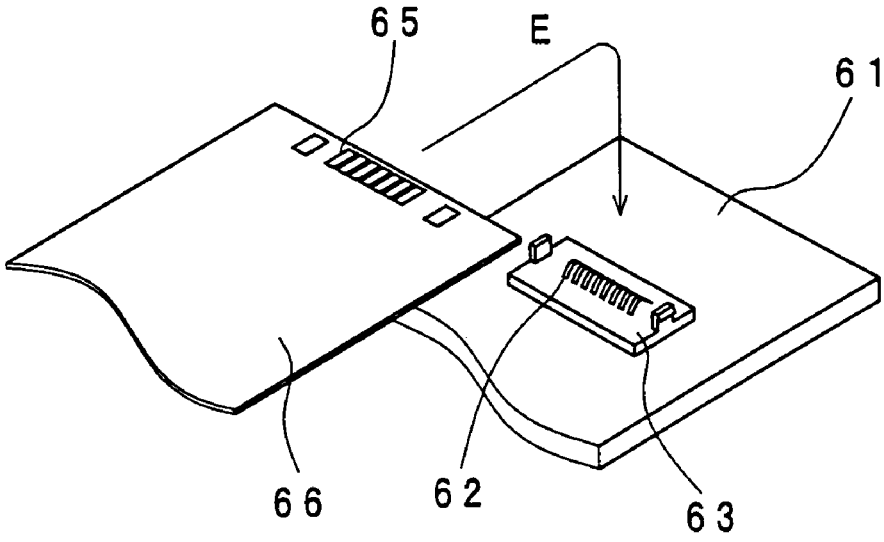
Fig. 6 PRIOR ART
FIG. 6 is a perspective view showing another prior art flexible board connector.
Figure 7:
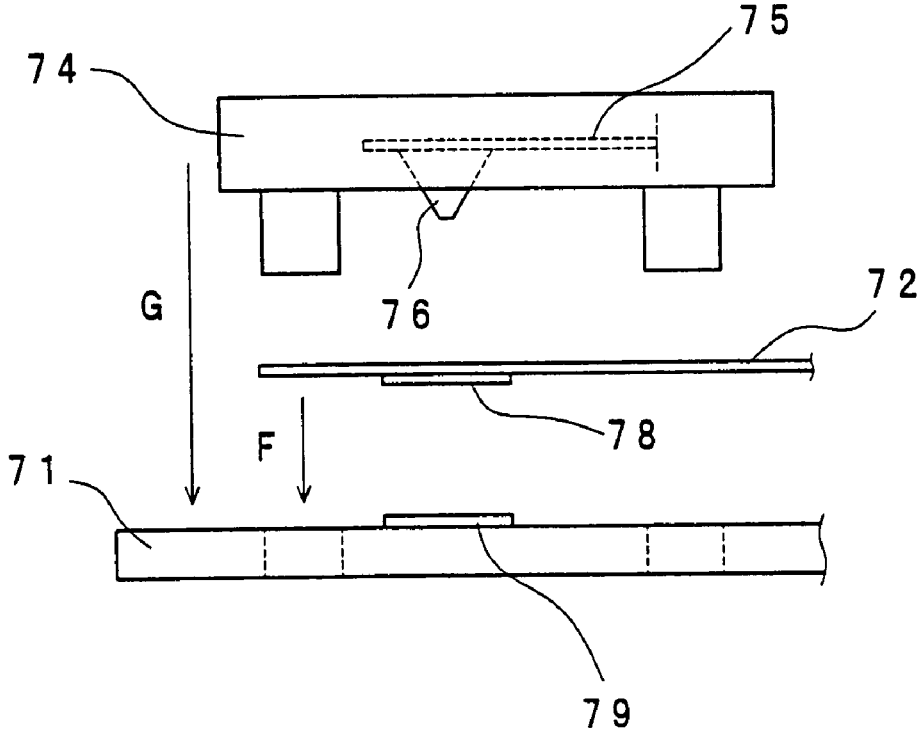
Fig7 PRIOR ART
FIG. 7 is a side view showing yet another prior art flexible board connector.

Subsequently, the press member 8 is moved toward the first contact 3 as shown in FIG. 4. As a result of this, the clamp surface 8*b* of the press member 8 presses the flexible board 30 downwardly. Also, the push-up block 10 is moved upwardly by the slide member 8*c* moving toward the first contact 3 along with the press member 8. Consequently, the upper surface of the push-up block 10 presses the inside contact portions 3*a*, 4*a* of the first and second contacts 3, 4 upwardly. In this way, the insertion hole 9 is narrowed so that a portion of the flexible board 30 and the inside contact portions 3*a*, 4*a* of the first and second contacts 3, 4 are sandwiched between the clamp surface 8*b* of the press member 8 and the upper surface of the push-up block 10. As a result, the connecting portion 31 of the flexible board 30 and the contact terminals 3*d*, 4*d* of the first and second contacts 3, 4 are securely brought into contact with each other so as to be electrically and mechanically connected to each other.

When the press member 8 moves toward the first contact 3, the cover portion 8*a* of the press member 8 is positioned above the opening 6 of the casing 2. When this occurs, the press member 8 slides in the state that the press member 8 is fitted to the groove of the casing 2. Thereby, the cover portion 8*a* of the press member 8 causes the portion of the flexible board 30 located outside the insertion hole 9 of the casing 2 to be bent toward the upper surface of the casing 2. As a result, the portion of the flexible board 30 located outside the insertion hole 9 is oriented along a direction generally parallel to the surface of the circuit board 40.

Thus, a connection structure between the flexible board and the circuit board according to the present invention is obtained.

Figure 3:
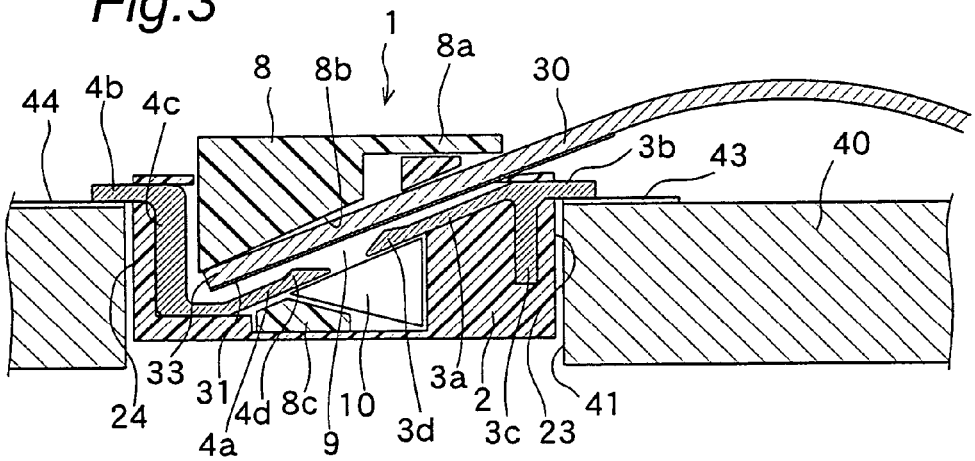
FIG. 3 is a sectional view showing a state in which the flexible board is connected to the circuit board by using the flexible board connector according to the embodiment of the present invention.

By virtue of the orientation that the portion of the flexible board 30 located outside the insertion hole 9 is oriented along the direction generally parallel to the surface of the circuit board 40, such disadvantages as shown below can be prevented. That is, in the case where the flexible board 30 is inserted obliquely into the connector 1, the portion of the flexible board 30 located outside the insertion hole 9 bends to draw an arc as shown in FIG. 3 because the flexible board 30 has some degree of stiffness as well as flexibility. The stiffness of the flexible board 30 may allow this arc-portion of the flexible board 30 to protrude to a large extent from the surface of the circuit board 40. If the flexible board 30 is fixed as the flexible board 30 remains in the protruding state, assembly worker's hand or tools or the like may be caught by the protruding portion of the flexible board 30. This may cause such disadvantages as disconnection of the flexible board 30 from the connector or damage of the flexible board 30.

Accordingly, in this embodiment, the portion of the flexible board 30 located outside the insertion hole 9 is bent to the direction generally parallel to the surface of the circuit board 40 by the cover portion 8*a* of the press member 8, as shown in FIG. 4. Thereby, the flexible board 30 can effectively be prevented from protruding from the surface of the circuit board 40. Therefore, the flexible board 30 can effectively be prevented from such disadvantages as being disconnected from the connector or being damaged.

Although the flexible board connector 1 in this embodiment include the plural first and second contacts 3, 4, the flexible board connector 1 may include only either one of the first contact 3 or the second contact 4. In this case, a dummy outside contact portion is preferably formed at a position on a side surface of the casing 2 which position corresponds to the outside contact portion of the other contact. The casing 2 can stably be fixed to the circuit board 40 when one of the outside contact portions 3*b*, 4*b* of the first and second contacts 3, 4 is fixed to one of terminals 43, 44 of the circuit board 40 and the dummy outside contact portion is fixed to the surface of the circuit board 40.

Although the casing 2 of the flexible board connector 1 in this embodiment is placed in the through-hole 41 of the circuit board 40, the casing 2 may be placed in a non-through-hole which is provided in the circuit board and has a depth shallower than the thickness of the circuit board. In this case, the bottom surface of the casing 2 is not exposed in the rear side surface of the circuit board. Therefore, such disadvantages as protrusion or disconnection of the casing 2 can be prevented even if some force is exerted from the rear surface side of the circuit board.

Although the portion of the casing 2 is placed within the through-hole 41 in the flexible board connector 1 of this embodiment, the entire casing may be placed within the through-hole. As a result of this, the flexible board connector can be made almost never protruding from the circuit board 40. In this case the first and second contacts may be drawn outside from the upper side surface of the casing.

Further, the push-up block 10 in the casing 2 may be omitted. That is, the insertion hole 9 may be narrowed only by the press member 8.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. A flexible board connector comprising:

a casing;

a contact having an inside contact portion located inside the casing and an outside contact portion protruding from proximity to an upper end of a side surface of the casing;

clamp means at least partly placed within the casing, being movable relative to the casing, and having a clamp surface forming an insertion hole together with at least the inside contact portion of the contact, wherein a movement of the clamp means relative to the casing makes the insertion hole narrower; and wherein the clamp means is slidable and includes the clamp surface which is adapted to be on a first side of a flexible board to be clamped and a slide member which slides together with the clamp surface and is adapted to be on a second side of the flexible board within the casing so that the flexible board is adapted to be located between the clamp surface and the slide member of the clamp means.

2. The flexible board connector as claimed in claim 1, wherein an opening of the insertion hole is positioned in proximity to the upper end of the side surface of the casing.

3. The flexible board connector as claimed in claim 1, wherein an outer peripheral surface of the casing is generally cup-like shaped, and the insertion hole is oriented to an oblique direction with respect to a bottom surface of the casing.

4. The flexible board connector as claimed in claim 1, wherein the clamp means has a holding portion for bending a non-clamp portion of the clamped flexible board to a particular direction.

5. The connector of claim 1, wherein the slide member of the clamp means, when slid along with the clamp surfaces, engages a sloped surface of a wedge-shaped push-up block thereby causing the push-up block to move upwardly toward the contact to clamp the flexible board in the connector between the contact and the clamp surface.

6. The connector of claim 1, wherein the clamp surface and the slide member of the clamp means are integrally formed with one another.

7. A connection structure between a circuit board and a flexible board, comprising:

the flexible board connector as defined in claim 1;

a circuit board having a circuit, a connecting terminal connected to the circuit, and a hole formed in proximity to the connecting terminal; and a flexible board having wiring, and a connecting terminal connected to the wiring, wherein at least a portion of the casing of the flexible board connector is placed inside the hole of the circuit board, the connecting terminal of the circuit board is connected to the outside contact portion of the contact of the flexible board connector, and a portion of the flexible board is positioned within the insertion hole of the flexible board connector and clamped by the clamp means, while the connecting terminal of the flexible board is connected to the inside contact portion of the contact of the flexible board connector.

8. The connection structure between a circuit board and a flexible board as claimed in claim 7, wherein the hole of the circuit board is a through-hole passing through the circuit board.

9. A connection structure between a circuit board and a flexible board, comprising:

a flexible board connector comprising:

a casing;

a contact having an inside contact portion located inside the casing and an outside contact portion protruding from proximity to an upper end of a side surface of the casing;

clamp means at least partly placed within the casing, being movable relative to the casing, and having a clamp surface forming an insertion hole together with at least the inside contact portion of the contact, wherein a movement of the clamp means relative to the casing makes the insertion hole narrower;

a circuit board having a circuit, a connecting terminal connected to the circuit, and a hole formed in proximity to the connecting terminal; and a flexible board having wiring, and a connecting terminal connected to the wiring, wherein:

at least a portion of the casing of the flexible board connector is placed inside the hole of the circuit board, the connecting terminal of the circuit board is connected to the outside contact portion of the contact of the flexible board connector, a portion of the flexible board is positioned within the insertion hole of the flexible board connector and clamped by the clamp means, while the connecting terminal of the flexible board is connected to the inside contact portion of the contact of the flexible board connector;

the opening of the insertion hole of the flexible board connector is positioned in an upper surface of the casing in proximity to the upper end of the side surface of the casing, an outer peripheral surface of the casing of the flexible board connector is generally cup-like shaped, and the insertion hole is oriented to an oblique direction with respect to a bottom surface of the casing, the clamp means of the flexible board connector has a holding portion, and a portion of the flexible board located outside the insertion hole is bent by the holding portion of the clamp means of the flexible board connector so as to be oriented substantially parallel to a top surface of the circuit board.

10. A connection structure between a circuit board and a flexible board, comprising:

a flexible board connector comprising:

a casing;

a contact having an inside contact portion located inside the casing and an outside contact portion protruding from proximity to an upper end of a side surface of the casing;

clamp means at least partly placed within the casing, being movable relative to the casing, and having a clamp surface forming an insertion hole together with at least the inside contact portion of the contact, wherein a movement of the clamp means relative to the casing makes the insertion hole narrower;

a circuit board having a circuit, a connecting terminal connected to the circuit, and a hole formed in proximity to the connecting terminal; and a flexible board having wiring, and a connecting terminal connected to the wiring, wherein:

at least a portion of the casing of the flexible board connector is placed inside the hole of the circuit board, the connecting terminal of the circuit board is connected to the outside contact portion of the contact of the flexible board connector, a portion of the flexible board is positioned within the insertion hole of the flexible board connector and clamped by the clamp means, while the connecting terminal of the flexible board is connected to the inside contact portion of the contact of the flexible board connector; and the hole of the circuit board is a non-through-hole having a depth smaller than thickness of the circuit board.

11. A connection structure between a circuit board and a flexible board, comprising:

a flexible board connector comprising:

a casing;

a contact having an inside contact portion located inside the casing and an outside contact portion protruding from proximity to an upper end of a side surface of the casing;

clamp means at least partly placed within the casing, being movable relative to the casing, and having a clamp surface forming an insertion hole together with at least the inside contact portion of the contact, wherein a movement of the clamp means relative to the casing makes the insertion hole narrower;

a circuit board having a circuit, a connecting terminal connected to the circuit, and a hole formed in proximity to the connecting terminal; and a flexible board having wiring, and a connecting terminal connected to the wiring, wherein:

at least a portion of the casing of the flexible board connector is placed inside the hole of the circuit board, the connecting terminal of the circuit board is connected to the outside contact portion of the contact of the flexible board connector, and a portion of the flexible board is positioned within the insertion hole of the flexible board connector and clamped by the clamp means, while the connecting terminal of the flexible board is connected to the inside contact portion of the contact of the flexible board connector.

* * * * *